US005080165A

United States Patent [19]

Engelhardt

[11] Patent Number: 5,080,165

[45] Date of Patent: Jan. 14, 1992

[54] PROTECTIVE TARPAULIN

[75] Inventor: Michel Engelhardt, Brooklyn, N.Y.

[73] Assignee: Grumman Aerospace Corporation, Bethpage, N.Y.

[21] Appl. No.: 391,092

[22] Filed: Aug. 8, 1989

[51] Int. Cl.[5] ..... F41H 3/00

[52] U.S. Cl. ..... 165/46; 165/48.1; 428/118; 428/919; 342/3; 342/4; 89/36.01

[58] Field of Search ..... 428/116, 118, 919; 342/3, 4; 89/36.01; 165/46, 47, 48.1, 27

[56] References Cited

U.S. PATENT DOCUMENTS

| | | | |
|---|---|---|---|
| 2,980,573 | 4/1961 | Clifford | 428/118 |
| 2,985,880 | 5/1961 | McMillan | 342/4 |
| 3,349,396 | 10/1967 | Reed | 343/18 |
| 3,349,397 | 10/1967 | Rosenthal | 343/18 |
| 3,453,620 | 7/1969 | Fleming et al. | 343/18 |
| 3,509,568 | 4/1970 | Manning et al. | 343/18 |
| 3,806,928 | 4/1974 | Costanza | 428/118 |
| 4,287,243 | 9/1981 | Nielsen | 342/3 |
| 4,308,882 | 1/1982 | Pusch et al. | 428/919 |
| 4,413,668 | 11/1983 | Allard | 165/1 |
| 4,473,826 | 9/1984 | Pusch et al. | 342/3 |
| 4,495,239 | 1/1985 | Pusch et al. | 428/192 |
| 4,529,633 | 7/1985 | Karlsson | 428/919 |
| 4,609,034 | 9/1986 | Kosson et al. | 165/47 |
| 4,615,921 | 10/1986 | Johansson | 428/919 |
| 4,743,478 | 5/1988 | Pusch | 428/919 |
| 4,748,449 | 5/1988 | Landers, Jr. et al. | 343/705 |

*Primary Examiner*—John Ford

*Attorney, Agent, or Firm*—Scully, Scott, Murphy & Presser

[57] ABSTRACT

The present disclosure describes a protective tarpaulin which protects military targets from detection and destruction by multiple weapon systems. The tarpaulin comprises a thermal protective sheet situated at its bottom surface in contact with the target it covers. A multi-cell honeycomb structure is disposed above and separated from the thermal protective sheet by a plurality of stiffeners. The tarpaulin also includes a temperature control means, in communication with an air gap defined by the space between the multi-cell honeycomb structure and the thermal protective sheet.

20 Claims, 2 Drawing Sheets

PROTECTIVE TARPAULIN

BACKGROUND OF THE DISCLOSURE

1. Field of the Invention

The present invention is directed to a protective tarpaulin useful in protecting targets from multiple weapon systems. More specifically, the present invention is directed to a protective tarpaulin which shields a military target against surveillance, identification lock-on systems and high energy destruction weapons.

2. Background of the Prior Art

Surface military targets, including ground vehicles and installations, are susceptible to surveillance, identification and lock-on as well as destruction by high energy weapons. Thus, surface military targets are susceptible and vulnerable to multiple weapon systems in that these weapon systems provide surveillance, identification and lock-on as well as high energy weapon capability. That is, multiple weapon systems both search out and destroy the target to which they are aimed. Moreover, the surveillance, identification and missile lock-on capability of multiple weapon systems operate over multiple bands of the electromagnetic spectrum.

To better understand the dangers to surface military targets posed by multiple weapon systems it must be understood that these systems are provided with three capabilities: passive surveillance capability, active surveillance capability and high energy weapon capability. These threat system capabilities, and the danger they pose to military targets, are considered hereinafter.

Those skilled in the art are aware that passive surveillance systems, provided in multiple weapon systems, include passive detection, recognition and identification utilizing electro-optical systems operating in the visual, radio frequency and infrared wavelength bands. Visual systems operate in the 0.4 to 0.7 micrometer portion of the electromagnetic spectrum. These systems rely on the visual, that is, that which is recognizable by the human eye. In addition, optical augmentation systems, which range from hand-held binoculars to video display terminals with zoom-in capability, are provided in multiple weapon systems. Detection mechanisms employed in visual systems are accomplished through color and/or brightness contrast.

Passive systems which operate in the infrared wavelength bands, the 0.8 to 14 micrometer portion of the electromagnetic spectrum, which includes the solar band, the high temperature band and the low temperature band, operate by homing-in on the contrast between the target and its background. Such systems as the forward looking infrared systems on aircraft and helicopters, infrared missile seekers on air-to-surface and surface-to-surface missiles, electro-optical/infrared surveillance/warning systems on land or air combat vehicles and electro-optical/infrared sensors in space are among the many currently used infrared passive systems utilized to identify military targets.

Active systems utilized by multiple weapon systems include both active optronic and radar systems. Optronic systems operate either as laser rangefinders or coupled laser/electro-optical rangefinders/missile lock-on systems. These systems generally rely on the retroreflection of surface materials for detection, recognition, identification and lock-on. These systems are tuneable and operate in both the visual and infrared portions of the electromagnetic spectrum.

Radar systems, another class of active systems, operate between decametric waves (high frequency) to and including millimetric waves (extremely high frequency) portions of the electromagnetic spectrum. Radar systems are designed to emit a pulse of electromagnetic energy and rely on the echo return of the reflected pulse to detect, recognize, classify and identify the target.

Finally, high energy weapons utilized in multiple weapon systems, to which military targets are vulnerable, are either high energy lasers or nuclear detonating weapons.

The development, in recent years, of multiple weapon systems, which incorporate passive surveillance systems, active surveillance systems and high energy weapons, necessitates an appropriate response to protect military targets which these multiple weapon systems are designed to destroy. That is, there is a need in the art to develop a single countermeasure to protect ground military targets against all the potential threats posed by the multiple weapon systems discussed above.

Tarpaulins are traditionally utilized in the covering of various stationary objects. When utilized to cover military-related devices, such as buildings, weapons, vehicles and the like, they are employed not only to protect the covered object but may also be used to camouflage it. It may be argued, however, that coverings for military targets used in the prior art were not tarpaulins in the traditional sense. That is, the camouflage systems of the prior art, used in military applications, have not been characterized by the mobility associated in the prior art with tarpaulins.

Among the camouflage systems utilized in the prior art, mention should be made of the system of U.S. Pat. Nos. 4,473,826 and 4,495,239. These patents disclose a covering utilized to camouflage military targets. The target covered by the camouflage system of these patents has the common characteristic of generating heat. The camouflage system of the '826 and '239 patents protect against detection by sensors responsive to radar, infrared, visible and ultraviolet electromagnetic frequencies. The covering of these patents encompasses a camouflage netting provided with an infrared reflecting layer and an internal forced air heat redistribution system.

U.S. Pat. No. 4,609,034 describes another infrared camouflage system where air is forced through camouflage panels so that infrared emissions through the panels from a covered heat source are minimized. A sensor controls the air flow rate through the panels by responding to ambient infrared conditions and emissions from the panel.

U.S. Pat. Nos. 3,349,396 and 3,349,397 are both directed to a flexible radiation attenuator. This attenuation is provided by a flexible material, which covers military vehicles, that attenuates radiation in the radar frequency range.

These systems, although having in common the purpose of camouflaging surface targets from military weapons, do not provide against detection, identification and lock-on capability of a target, provided by passive and active systems, in combination with protection against the devastating effect of a high energy weapon. Moreover, none of these systems are lightweight, highly mobile devices of the type that are normally categorized as tarpaulins. Thus, there is a recognized need in the art to develop such a tarpaulin as a military protective system effective against multiple weapon systems which is, at the same time, flexible, mobile and quickly assemblable for use to cover and protect military targets.

BRIEF SUMMARY OF THE INVENTION

A new protective device has now been conceived which is highly mobile, flexible and quickly assemblable and which covers and protects military targets from multiple weapon systems provided with passive and active target detection, identification and lock-on capability and high energy weapons.

In accordance with the present invention a tarpaulin is provided. The tarpaulin comprises a thermal protective sheet provided at its bottom surface in contact with the military target over which it is disposed. Siffening means, connected to the thermal protective sheet, defines the height of the tarpaulin. A multi-cell honeycomb structure is connected to the end of the stiffening means opposite the end connected to the thermal protective sheet. The multi-cell honeycomb structure includes a bottomsheet at its bottom end. The space between the thermal protective sheet and the multi-cell honeycomb structure bottomsheet defines an air gap which is in communication with a temperature control means. The temperature control means maintains the tarpaulin in thermal equilibrium with its surroundings.

BRIEF DESCRIPTION OF THE DRAWINGS

The present invention may be better understood with reference to the accompanying drawings of which.

DETAILED DESCRIPTION

Figure 5:
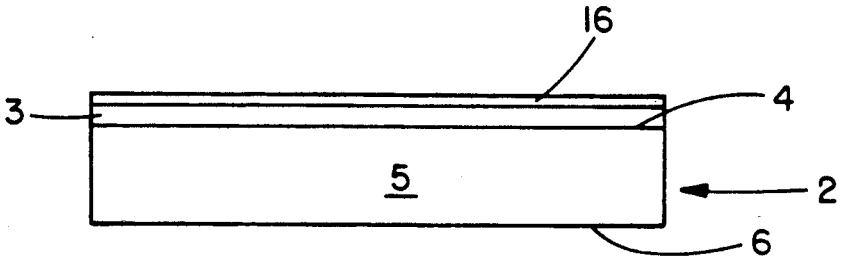
FIG. 5 is an elevation view of the thermal protection sheet of the tarpaulin.

The tarpaulin of the present invention, generally illustrated at 10, includes a thermal protective sheet 2, disposed at its bottom, in contact with the military target (not shown) over which it is disposed. The thermal protective sheet 2, as will be discussed hereinafter, represents the last component of protection of the tarpaulin 10 against a high energy weapon. The thermal protective sheet 2, as illustrated in FIG. 5, is, in a preferred embodiment, a sheet of a metal denoted at 5. The metal is characterized by surfaces 4 and 6. Surface 6 is the bottom of the tarpaulin 2 adjacent the target which the tarpaulin 10 covers. The opposed surface, surface 4, is characterized by a highly reflective surface. This surface is, in turn, coated with a degradable polymer coating 3.

The thermal protection sheet 2 is preferably a metal. Of the metals that may be used as the sheet 2, aluminum is preferred. The surface 4, as stated above, of sheet 2 is highly polished so as to be radiant reflective. This reflective surface is covered with a polymer coating 3. The polymer of the polymer coating 3 is cleanly degradable. That is, the degradable polymer of polymer coating 3 is easily vaporized by high energy. A paint pigment 16, whose function is discussed hereinafter, covers the polymeric coating 3.

Attached to the thermal protection sheet 2 are stiffening means. The stiffening means comprises a plurality of stiffeners 8. These stiffeners 8 act as reinforcing bars to stiffen the structure and connect the bottom most component, the thermal protective sheet 2, to a multi-cell honeycomb structure to be discussed below. The stiffeners 8 are constructed of a highly rigid material which is rust resistant.

It is emphasized that the stiffeners 8 are fastened to the thermal protection sheet 2 by suitable fastening means (not shown). Such well known fasteners as welds, screws, rivets and the like are utilized to provide this function.

Figure 1:
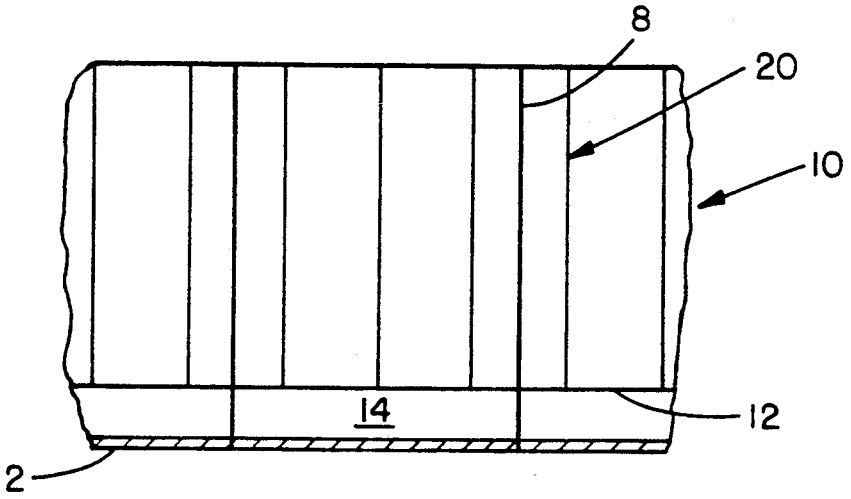
FIG. 1 is a sectional elevation view of the tarpaulin of the present invention.
Figure 2:
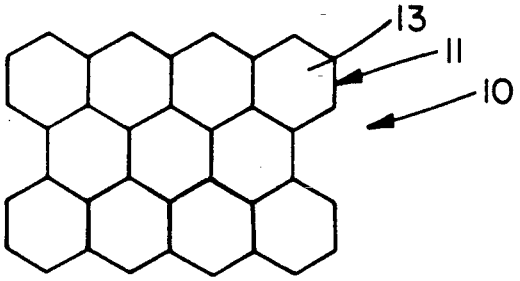
FIG. 2 is a top view of the tarpaulin of the present invention illustrating the multi-cell honeycomb structure arrangement.
Figure 3:
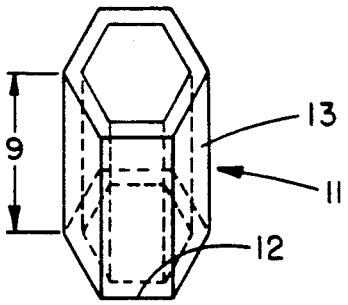
FIG. 3 is an isometric sketch of a single cell of the multi-cell honeycomb structure of the tarpaulin of the present invention.

The multi-cell honeycomb structure, mentioned in the above paragraph and indicated generally by reference numeral 20, comprises a plurality of hexagonally shaped, hollow cells 11, one of which is illustrated at FIG. 3. In a preferred embodiment each honeycomb cell 11 is characterized by a height, the dimension 9, of approximately ¼ inch. Preferably, the height of each honeycomb cell 11 is less than ¼ inch. As best depicted in FIG. 2, the multiplicity of hexagonally shaped cells 11 fit together to form the honeycomb structure 20. This structure provides structural strength consistent with minimum weight.

The honeycomb structure 20 is hollow. Each of the cells 11 is either open or closed at its top side, the side of the tarpaulin 10 opposite that in contact with the target it covers. In a preferred embodiment each of the cells 11 is open at its top side. The bottom of each cell 11, on the other hand, is closed by means of a honeycomb backsheet 12. The space defined by the opening between the honeycomb backsheet 12 and the thermal protection sheet 2, an air gap 14, is utilized, as discussed below, as a means for controlling the temperature of the tarpaulin 10.

Each cell 11 comprises a geometric shape. Particularly preferred geometric shapes of cell 11 include a six-sided hexagon and a four-sided square. Of these two preferred shapes, the six-sided hexagon is more preferred. Independent of which geometric shape is utilized, those skilled in the geometric arts are aware that each side 13 of cell 11 is identical with the other sides which comprise the cell. For example, in the preferred case where a hexagonal shaped cell is employed, each side 13 of the six-sided cell 11 is identical.

The sides 13 of the cell 11 are constructed of a high thermal conductivity material. In that the cell must be constructed of a low density/high strength and high thermal conductivity material, two metals immediately suggest themselves for use in this application. Thus, the material of construction of each of the cell walls 13 of each cell 11, which combine to form the multi-cell honeycomb structure 20, is preferably aluminum. In addition to these metals, composite materials, that is, fiber-reinforced plastics, may also be used although their excellent low density-high strength characteristic may be compromised by their relativity low thermal conductivity.

Figure 4:
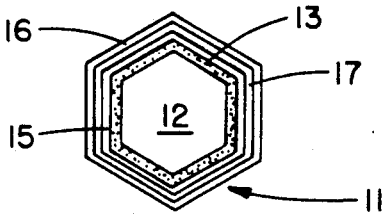
FIG. 4 is a top view of FIG. 3 depicting the coatings disposed on said cells.

Each side 13 of cell 11 is covered with a paint pigment 16. The use of the same reference numeral 16 as that employed to denote the paint pigment on the top side of the backsheet 12 evidences the fact that, in a preferred embodiment, the same pigment is employed. In addition, a third coating is disposed on side 13. This metallic coating 17 is situated between a coating 15 and the outer paint pigment 16. For ease in understanding, the disposition of the coatings are depicted in FIG. 4 but not in FIG. 3.

The purpose of the coating 15 is to minimize solar reflections. The constituency of the coating 15, provided on the surfaces of each side 13, is preferably a polymeric composition which includes carbon black to enhance absorptivity and minimize reflectivity. Among the polymers preferred for use in the polymeric composition coating are urethane polymers and acrylic polymers. As in its use on the top side of the thermal protection sheet 2, outer paint pigment 16 is provided for camouflaging purposes. The intermediate metallic coating 17 aids in the absorption of radio frequency waves emitted by a multiple weapon system.

As in the fastening of the thermal protection sheet 2, stiffeners 8 are connected to the multi-cell honeycomb structure 20 by suitable fastening means (not shown). Again, any of the well known fastening expedients known in the art, such as welds, screws, rivets and the like, may be utilized in fastening the cells 11 to the stiffeners 8. Those skilled in the art will appreciate that the multi-cell honeycomb structure 20 is itself preferably preformed and thus there is no need for the use of fastening means in its construction.

Figure 6:
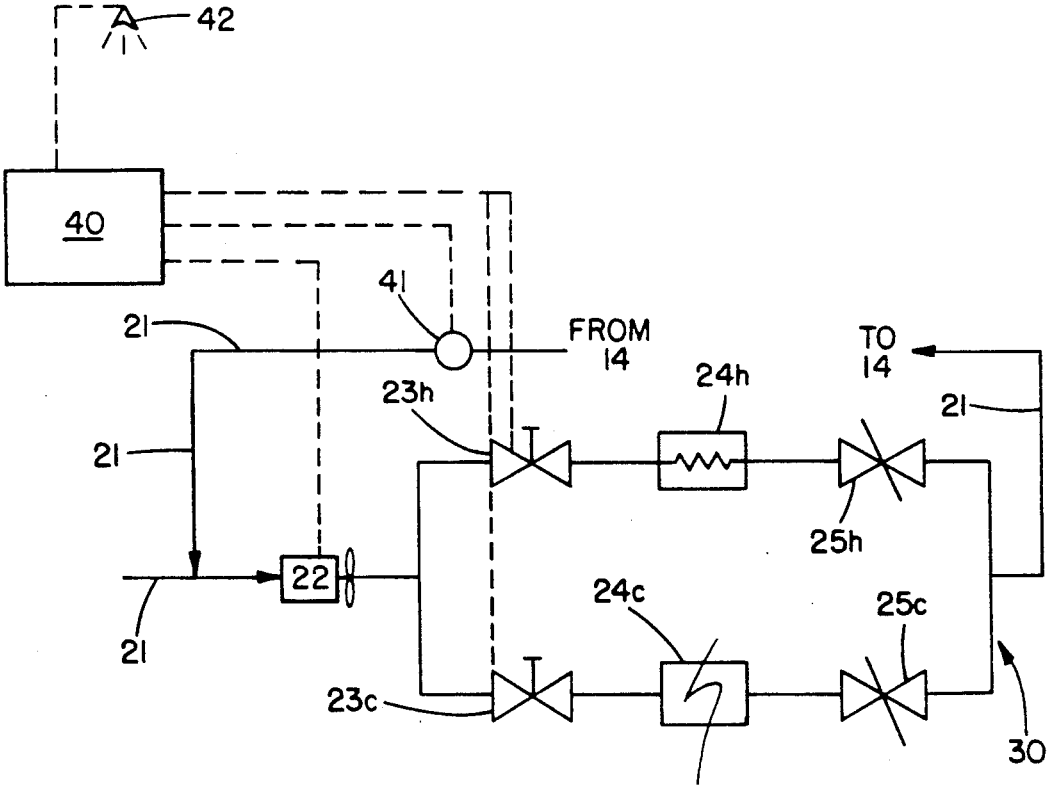
FIG. 6 is a schematic representation of the air circulating temperature control means in communication with the air gap of the tarpaulin.

The air gap 14 defined by the space between the honeycomb backsheet 12 and the thermal protection sheet 2, communicates with a temperature control means 30. The temperature control means 30 is schematically represented in FIG. 6. It includes a conduit 21, in communication with the air gap 14, for transporting air into and out of the tarpaulin 10. Air is forced into the air gap 14 by means of a fan 22 in communication with the atmosphere and/or the outlet of conduit 21 exiting the air gap 14 of the tarpaulin 10. Air forced into the air gap 14 by the fan 22 is first heated or cooled in one of two parallel air flow paths disposed downstream of the fan 22.

The two paths are identical but for the use of an air heater and an air cooler depending upon whether air is to be heated or cooled. That is, both branches include a control valve 23. In the air heating branch, the valve is denoted as **23*h* while the valve in the cooling line is designated 23*c*. A pair of heat exchangers 24 are disposed downstream of the valves 23*h* and 23*c*. In the heating line, the heat exchanger, an air heater, is numbered 24*h* whereas 24*c* in the cooling path identifies the heat exchanger which acts as an air cooler. Any of the well known gaseous heat exchanger designs used in heating and cooling air may be used in this application. It is emphasized that although the two exchangers may be of the same design, there is no requirement that this be the case. Thus, heat exchanger 24*h* may be of different design than is heat exchanger 24*c*. A pair of check valves 25, again designated 25*h* and 25*c*** to identify the valves in the heating and cooling branches, respectively, complete the air heating and air cooling lines.

Control of the temperature control means 30 is provided by a computer means 40 which is responsive to an electro-optical sensor 42 which measures ambient temperatures and to a thermocouple 41, disposed in conduit 21 downstream of the outlet from the air gap 14. The computer means 40 is also in electronic communication with both cooling and heating branches of the temperature control means 30 through its electronic communication with control valves **23*c* and 23*h***.

In operation, the fixed military target to be protected, which may be a vehicle, such as a parked aircraft, a land combat vehicle, a ship or the like, or a fixed installation, such as a missile silo, an electrical power generating plant or the like, is protected by the unique tarpaulin 10 of the present application. The tarpaulin 10 both camouflages and protects the target from the targeting and destructive capabilities of multiple weapon systems.

In substantially all cases, the multiple weapon system identifies the target from above. That is, identification of the target is made from overhead. Thus, the target "sees" the surfaces of each side 13 of the geometrically shaped honeycomb cells 11 as well as the top of the multi-cell backsheet 12. In a preferred embodiment, each side 13 is provided with an outer covering, the deceptive paint pigment 16. Specifications for deceptive paint pigments are included in Federal Standards 595A which standard is incorporated herein by reference. In addition, the deceptive paint pigment 16 is applied as the outer covering of the top surface of the backsheet 12. Thus, the tarpaulin 10 provides protection against passive protection, recognition and identification systems included in multiple weapon systems.

The tarpaulin 10 is also provided with means for controlling its temperature by the passage of cold or hot air in the air gap 14 positioned between the honeycomb backsheet 12 and the thermal protective sheet 2. This results in thermal background matching, blunting another passive system used in multiple weapon systems to identify targets. That is, the target cannot be identified by radiant contrast. Radiant contrast is created by temperature differences between a target and its background.

Radiant emission in the solar range from the tarpaulin 10 is minimized, thus minimizing the possibility of identification of the target based thereon, by the polymeric coating 15. As stated above, the polymeric coating composition contains carbon black which is an excellent absorber of solar radiation. Thus, more than 95% of the solar radiation in contact with the surface of sides 13 is absorbed. Moreover, although the emissivity of the polymeric coating composition 15 is only as high as 0.85 still, when coupled with the cavity formed by the honeycomb structure, the effective emissivity is considerably increased. The resultant high emissivity results in the absorption of a high percentage of solar energy absorption.

It has been calculated, for example, that as the height, denoted at 9, of a cell 11 increases from 0 height to about ¼ inch, the emissivity rises, in a non-linear fashion, from 0.85 to about 0.98.

In summary, radiant emission from the tarpaulin 10 is controlled, and thus minimized, for the three main electro-optical system bands. In the solar band, 0.8 to 4 micrometers, the carbon black included polymeric composition coating 15 on the surfaces of the cells 11 of the multi-cell honeycomb structure 20 absorb over 95% of solar radiant intensity to minimize solar reflections which aid in the detection, recognition, identification and lock-on capabilities of passive systems of multiple weapon systems. As stated above the emissivity of these polymeric coatings are close to 0.85. Nevertheless, when coupled with the cavity formed by the multi-cell honeycomb structure 20, the effective emissivity is increased to an acceptably high level.

Another detection, recognition and identification deterrent provided by the tarpaulin 10 of the present invention is aimed at active identification systems included in multiple weapon systems. Laser rangefinder systems, an important active system, is largely incapacitated by the minimization of reflectivity provided by the unique multi-cell honeycomb structure 20. This minimization results from the high effective emissivity discussed earlier. Minimum retroreflection results in the absorption of substantially all the laser rangefinder energy. This minimization of retroreflection is the result of the inclusion of cavities in the honeycomb structure 20 which provides the means for trapping electromagnetic energy produced by the laser waves incident upon the tarpaulin 10. This minimizes the effectiveness of a laser system, a prime active system, detection, recognition and identification of ground targets.

The cellular structure of the multi-cell honeycomb structure 10, that is, the multiplicity of cells 11, also trap radar waves in that the cavity type surface created thereby, results in multiple electromagnetic reflections which are absorbed by the honeycomb walls. This absorption capability of each surface of the six sides 13 of cell 11 is enhanced by intermediate metallic coating 17, disposed between the polymeric coating composition 15 and the outer paint coating 16. The coating 17 enhances the cavity effect in the absorption of radio frequency (RF) waves. The total design features of the multi-cell honeycomb structure 20, additionally, has the further capability of reflecting an RF wave away from the direction of the incident wave.

In addition to the above-discussed deterents to detection, recognition, identification and lock-on of multiple weapon systems of the tarpaulin 10 of this invention, the tarpaulin 10 also has the capability to deter, mitigate and generally minimize the effectiveness of high energy weapons, included in multiple weapon systems. Thus, each surface 13 of each cell 11 of the multi-cell honeycomb structure 20 is a highly reflective plate. Of course, this high reflective surface is underneath coatings 15, 16 and 17. However, these coatings are degradable and would be cleanly removed, to expose this highly reflective surface, upon the absorption of the high energy released from weapon detonation.

More fundamentally, the design of the multi-cell honeycomb structure 20 results in substantial absorption of the energy emitted from a high energy pulse resulting from a nuclear explosion and/or a high energy laser. This absorption effectuates the vaporization of the honeycomb structure 20. The ablation and vaporization of the honeycomb structure 20 obviously attenuates the energy pulse created by the high energy weapon. That is, the combined product of honeycomb vaporization, a mixture of sandwiched air, vaporized debris and ambient air, acts as a strong attenuator of the pulsed energy which thus protects the target.

It is also emphasized that the presence of stiffeners 8 result in two distinctively different thermal gradients, resulting from the different coefficients of thermal expansion of the stiffeners 8 and the honeycomb structure 20. This effectuates the well-known "oversized restricted balloon effect." This effect causes an increased volume of vaporized debris, further attenuating the energy pulse.

Finally, the degradable coating 3 disposed on the surface of the thermal protective sheet 2 is burnt off by the high energy pulse revealing a highly reflective substrate. This reflective substrate further reduces the energy pulse, reducing the damage to the target over which the tarpaulin 10 is disposed.

The above embodiments are given to illustrate the scope and spirit of the present invention. These embodiments will make apparent, to those skilled in the art, other embodiments. These other embodiments are within the contemplation of the present invention. Therefore, the instant invention should be limited only by the appended claims.

What is claimed is:

1. A protective tarpaulin comprising:

a thermal protective sheet situated at the bottom surface of a tarpaulin in contact with the target covered by said tarpaulin;

a multi-cell honeycomb structure disposed above said thermal protective sheet and separated therefrom by a plurality of stiffeners defining an air gap therebetween;

a temperature control means, in communication with said air gap.

2. A tarpaulin in accordance with claim 1 wherein said multi-celled honeycomb structure comprises a plurality of geometrically shaped cells.

3. A tarpaulin in accordance with claim 2 wherein said geometrically shaped cells are hexagonally shaped.

4. A tarpaulin in accordance with claim 2 wherein each of said geometrically shaped cells includes a metal coated with a polymeric composition.

5. A tarpaulin in accordance with claim 4 wherein said polymeric composition coating comprises carbon black.

6. A tarpaulin in accordance with claim 5 wherein a deceptive pigment covers the outer surfaces of said geometrically shaped cells.

7. A tarpaulin in accordance with claim 6 including a metallic coating disposed between said polymeric composition coating and said outer deceptive pigment coating.

8. A tarpaulin accordance with claim 7 wherein said geometrically shaped cells are hexagonally shaped.

9. A tarpaulin in accordance with claim 2 wherein said multi-celled honeycomb structure comprises a honeycomb backsheet situated at the bottom end of said honeycomb structure whereby said air gap is defined by said backsheet and said thermal protection sheet.

10. A tarpaulin in accordance with claim 9 wherein said honeycomb backsheet is a metal sheet covered on its top surface with a polymeric layer.

11. A tarpaulin in accordance with claim 10 wherein said backsheet includes an outer coating of a deceptive pigment, disposed above said polymeric layer.

12. A tarpaulin in accordance with claim 1 wherein said thermal protection sheet comprises a metal whose top surface is reflective.

13. A tarpaulin in accordance with claim 12 wherein said thermal protection sheet further includes a polymeric coating disposed above said reflective metal surface.

14. A tarpaulin in accordance with claim 1 wherein said temperature control means comprises air conduit means in communication with an inlet into and an outlet out of said air gap; a fin, in communication with said conduit means, responsive to a computer means; an air heating branch and an air cooling branch, said air heating and air cooling branches disposed in parallel fluid flow arrangement in said air conduit means, situated downstream of said fan.

15. A tarpaulin in accordance with claim 14 wherein said air heating branch comprises a control valve responsive to said computer means; an air heating means for heating air, downstream of and in communication with said control valve; and a check valve, downstream of and in communication with said air heating means.

16. A tarpaulin in accordance with claim 15 wherein said air cooling branch comprises a control valve responsive to said computer means; an air cooling means for cooling air, downstream of and in communication with said control valve; and a check valve, downstream of and in communication with said air cooling means.

17. A tarpaulin in accordance with claim 14 comprising an electro-optical sensor, which measures ambient temperature, and a thermocouple provided in said air conduit means disposed downstream of said air gap, said electro-optical sensor and said thermocouple in electronic communication with said computer means.

18. A tarpaulin in accordance with claim 4 wherein said metal of said hexagonally shaped cells is aluminum.

19. A tarpaulin in accordance with claim 18 wherein said polymer of said polymeric coating composition is selected from the group consisting of polyurethanes and polyacrylates.

20. A tarpaulin in accordance with claim 12 wherein said metal of said thermal protection sheet is aluminum.

* * * * *

UNITED STATES PATENT AND TRADEMARK OFFICE

CERTIFICATE OF CORRECTION

PATENT NO. : 5,080,165

DATED : January 14, 1992

INVENTOR(S) : Michel Engelhardt

It is certified that error appears in the above-identified patent and that said Letters Patent is hereby corrected as shown below:

Column 8, line 60, Claim 14: "fin" should read as --fan--

Signed and Sealed this

Thirty-first Day of August, 1993

*Attest:*

*Attesting Officer*

Bruce Lehman

BRUCE LEHMAN

*Commissioner of Patents and Trademarks*